US005689866A

United States Patent [19]

Kasai et al.

[11] Patent Number: 5,689,866

[45] Date of Patent: Nov. 25, 1997

[54] PLASTIC ZIPPER

[75] Inventors: Juichi Kasai, Tokyo; Yoshihiro Tomomoto, Osaka; Osamu Uemura, Kanagawa, all of Japan

[73] Assignee: Showa Highpolymer Co., Ltd., Tokyo, Japan

[21] Appl. No.: 720,570

[22] Filed: Oct. 1, 1996

[30] Foreign Application Priority Data

May 30, 1995 [JP] Japan ..... 7-155445

[51] Int. Cl.[6] ..... B65D 33/00

[52] U.S. Cl. ..... 24/587; 24/400; 24/576; 383/63

[58] Field of Search ..... 24/587, 576, 588, 24/589, 399, 400; 383/63, 65

[56] References Cited

U.S. PATENT DOCUMENTS

| | | | |
|---|---|---|---|
| 3,038,225 | 6/1962 | Ausnit | 24/587 |
| 3,372,442 | 3/1968 | Ishimatsu | 24/587 |
| 4,362,198 | 12/1982 | Kamp . | |
| 4,778,282 | 10/1988 | Borchardt et al. | 24/587 |
| 4,854,017 | 8/1989 | Kamp | 24/587 |
| 4,947,525 | 8/1990 | Van Erden . | |
| 5,248,201 | 9/1993 | Kettner et al. | 24/587 |
| 5,272,794 | 12/1993 | Hamatani et al. . | |
| 5,351,369 | 10/1994 | Swain . | |
| 5,403,094 | 4/1995 | Tomic | 24/587 |
| 5,462,360 | 10/1995 | Tilman et al. . | |

FOREIGN PATENT DOCUMENTS

| | | | |
|---|---|---|---|
| 0564261 | 10/1993 | European Pat. Off. . | |
| 0666041 | 8/1995 | European Pat. Off. . | |
| 0477940 | 12/1953 | Italy | 24/576 |
| 63-203559 | 8/1988 | Japan . | |
| 1145325 | 9/1966 | United Kingdom . | |

*Primary Examiner*—Victor N. Sakran
*Attorney, Agent, or Firm*—Sughrue,Mion,Zinn,Macpeak & Seas, PLLC

[57] ABSTRACT

A plastic zipper has a pair of female (11, 13) and male (21, 23) hooks formed on the surface of plastic films, 10, 20 and an inside of the male hooks are engaged with a pressing rib 31 to form a sealing section independent of a locking section constituted by the pair of female and male hooks. The zipper permits good hermetic sealing performance, easy opening, and easy reseating.

10 Claims, 3 Drawing Sheets

PLASTIC ZIPPER

BACKGROUND OF THE INVENTION

1. Field of the Invention

The present invention relates to a plastic zipper which permits good hermetic sealing performance, easy opening, and easy resealing. The plastic zipper in accordance with the present invention is useful for packaging materials for food and drink, pharmaceuticals, chemicals, office supplies, electronic components, photographic chemicals, etc.

2. Description of the Related Art

Packaging materials with plastic zippers which are opened by peeling and resealed by pressing are widely used as packaging bags for granular, powdery and other solid materials mainly due to their light weight and inexpensiveness. Although there are a wide variety of shapes of the zipper hooks of the packaging materials with zippers, most of them are intended for solid contents. For this reason, the majority of such zipper hooks are designed with an emphasis placed on smooth opening and closing of the zippers rather than high hermetic sealing performance. No plastic zippers have yet been developed for flat bags, gusset containers, standing pouches, paper packages, deep draw hermetically sealed containers, etc. which are required to have hermetic sealing performance for holding liquids and the like. A structure which enhances the hermetic sealing performance of a zipper by providing the distal ends of hooks with a push-up valve has been proposed in, for example, Japanese Patent Laid-Open No. 63-203559. This structure, however, requires reduced rigidity of female hooks for fitting; therefore, the hermetic sealing effect is almost lost when pressure is applied by the contents inside or when a dropping shock is applied.

Thus, since the conventional resealable plastic packaging materials are intended for packaging solid substances, they do not have with high hermetic sealing performance (impermeability to gases) for maintaining the quality of the contents inside or for preventing the leakage of liquid contents. The conventional resealable plastic packaging materials also lack in satisfactory durability, heat resistance, shock resistance, pressure resistance, etc., making them unsuitable for holding beverages, retort food, a large volume of liquid, or the like. Therefore, most conventional plastic packaging materials for holding liquids employ heat sealing to seal the openings thereof.

There has been a demand for a packaging material with a plastic zipper for holding liquids which is least bulky when empty, which is lightweight and inexpensive despite its large capacity, and which is easy to open and reseal; however, no such packaging materials with plastic zippers that respond to these demands have been developed.

Accordingly, it is an object of the present invention to provide a plastic zipper applicable to a packaging material which exhibits good hermetic sealing performance, high durability, high heat resistance, high shock resistance, and high pressure resistance, which is suited for holding liquids and which is capable of holding a large volume.

SUMMARY OF THE INVENTION

As a result of extensive investigation, the present inventors have overcome the above problems.

That is, the present invention provides a plastic zipper comprising a pair of female and male hooks formed on the surface of a plastic film, wherein an inside of the female hooks and an inside of the male hooks are engaged with each other to form a sealing section independent of a locking section which comprises a pair of female and male hooks of said zipper.

Further, the present invention provides a the plastic zipper wherein the sealing section is formed between a groove-like tightening wall provided inside of the hooks on the one side of the locking section and a pressing rib provided inside of the hooks on the other side thereof.

Furthermore, the present invention provides a plastic zipper wherein the section of the tightening wall inside of the hooks is shaped like a continuous groove which is narrower downward and wider upward.

Still further, the present invention provides a plastic zipper wherein the pressing rib and the surface of the tightening wall come in line contact or surface contact to form the sealing section.

Yet further, the present invention provides a plastic zipper, wherein at least one independent wall is provided inside of the hooks on the one side and at least two pressing ribs are provided inside of the hooks on the other side, so that the independent wall is brought in contact with the pressing ribs inside of the pressing ribs so as to form the sealing section.

Further, the present invention provides a plastic zipper, wherein at least two tightening walls are provided inside of the hooks on the one side and at least one pressing rib is provided inside of the hooks on the other side, the pressing rib having a distal end extended on both sides which comes in contact with both tightening walls to form the sealing section, and the outside walls of the tightening walls and the hooks on the other side forming the sealing section.

Furthermore, the present invention provides a plastic zipper, wherein a locking holder extends from the male hook to the outside wall of the female hook to contact with each other thereby forming an additional sealing section.

Still further, the present invention provides a plastic zipper, wherein either the tightening wall or the pressing rib is made rigid and the other is made elastic.

DETAILED DESCRIPTION OF THE INVENTION

Figure 1:
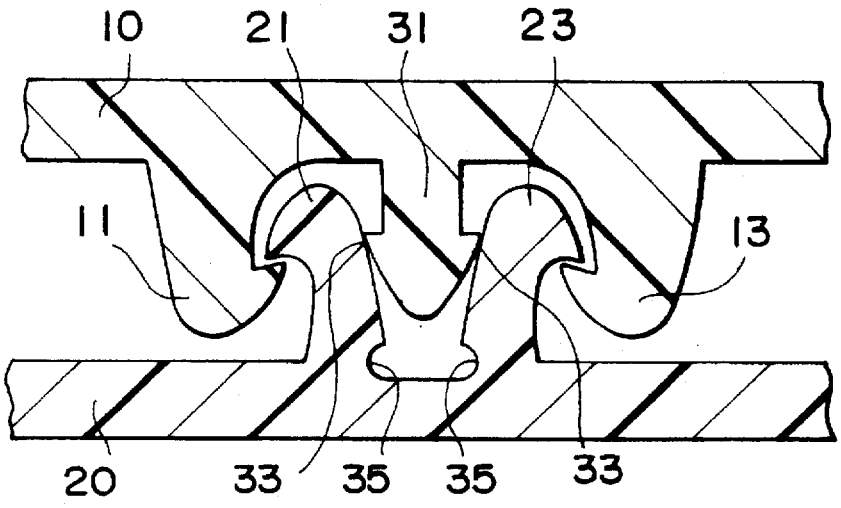
FIG. 1 is a cross-sectional view showing an embodiment of a plastic zipper in accordance with the present invention which is equipped with a tightening wall formed inside of the male hooks.

The packaging material herein means a packaging bag or a container for packaging.

The plastic used as the material for a zipper according to the present invention may be the same type or a different type of plastic used for the main body of a packaging material as long as it exhibits the rigidity of a typical thermoplastic and close adhesion to the plastic of the main body of a packaging bag or a packaging container. Preferably, to a portion of the zipper which should exhibit high rigidity is employed a plastic having high rigidity, while to a portion thereof which should exhibit elasticity is employed a plastic presenting elasticity; however, it generally makes manufacture difficult and also adds to cost to use different materials for different portions of the zipper. For this reason, efforts should be focused on shapes which maximize the aforesaid performances.

The female and male hooks themselves which form the locking section of the plastic zipper in accordance with the present invention are essentially the same as the hooks of a conventional plastic zipper except that they have tightening walls and pressing ribs inside thereof. In the plastic zipper in accordance with the present invention, either the inside of the female hooks or the male hooks is provided with a sealing section so as to seal a liquid content inside. The hooks are so configured that, once they have been engaged, it is difficult to open from the internal pressure, while it is easy to open from outside.

In a preferred embodiment, the male hooks composing the zipper exhibits rigidity; the rigidity around the centerline of the male hooks is reduced so as to make the hooks deform toward the centerline by an external force generated when the zipper is closed. This allows the zipper to be closed easily since the male hooks bend inward.

A tightening wall formed inside of the male or female hooks preferably has a shape of a continuous groove such as an inverted triangle, i.e. tapered, either straight or curved, so that the tightening wall comes in close contact with the pressing rib located between the female or male hooks to maintain the packaging material airtight.

The other hooks have adequate rigidity to make them resistant to an external force so that the hooks do not deform easily. Preferably, a pressing rib is provided between the hooks so as to form a complete sealing section through line contact or surface contact with the tightening wall provided between the mating hooks.

The line contact or the surface contact is employed depending on each application; if mere hermetic sealing is required, any contact may be used as long as it provides close contact by the distal end of the pressing rib being pressed against the surface of the tightening wall when the locking section of the plastic zipper is locked. If the packaging material is required to provide resistance to high pressure or high hermetic sealing performance, it is accordingly necessary to use a material with higher rigidity for the locking section and also to increase the adhesion pressure of the sealing section.

The profile of the tightening wall, e.g., groove, of the sealing section may be shaped like an inverted triangle of straight or gently curved lines.

The distal end of the pressing rib which comes in contact with the surface of the tightening wall may have a section of any shape such as semicircle, ellipse, triangle, rectangle, ladder shape, or polygon as long as it provides line contact or surface contact with the surface of the tightening wall. From the viewpoint of ease of manufacture, however, the section of the distal end of the pressing rib is preferably semicircular, ellipse, or rectangular.

The present invention will now be described in more detail in conjunction with the accompanied drawings.

FIG. 1 is a sectional view representing a plastic zipper which is an embodiment of the present invention; the sectional view being obtained by cutting the plastic zipper at right angles with respect to the length thereof. A plastic film 10 is provided with a pressing rib 31 inside of female hooks 11 and 13; another plastic film 20 is provided with male hooks 21 and 23 which engage with the female hooks 11 and 13. Provided on the shoulder sides, i.e. inner sides, of the male hooks are tightening walls 33 forming a groove which is narrower downward and wider upward. The surface of the walls 33 may be flat or curved as long as it provides sealing when the pressing rib 31 is pressed against the walls 33; however, a surface with a slight curvature may be advantageous from the viewpoint of manufacture.

It is not easy to achieve high accuracy in shape when molding; therefore, one of the pressing rib 31 and the tightening walls 33 should be made rigid while the other should be made elastic in order to enhance the hermetic sealing performance. However, providing the female and male hooks of the locking section with flexibility would be problematic; it would be difficult to manufacture the zipper by using different materials for the hooks and the pressing rib or the tightening walls. Accordingly, for example, it is preferable to make the bottom part thick on the one side which should exhibit high rigidity while making the bottom part thin on the other side which should exhibit elasticity by providing a recess 35.

Figure 2:
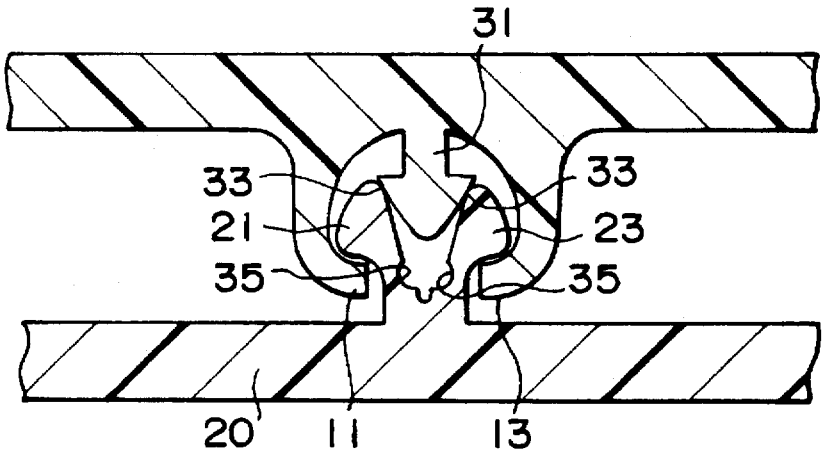
FIG. 2 is a cross-sectional view showing another embodiment of a plastic zipper in accordance with the present invention which is equipped with a tightening wall formed inside the male hooks.

FIG. 2 shows another embodiment having a different configuration. This type is effective for making the plastic zipper compact; it is ideally suited for a thin film or a small-capacity packaging means.

Figure 3:
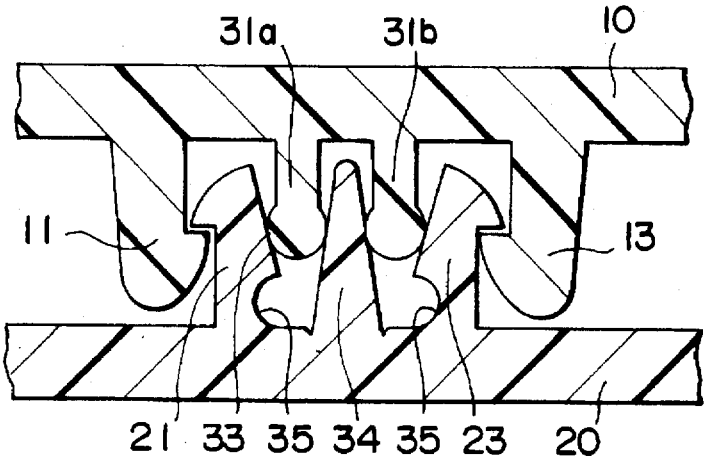
FIG. 3 is a cross-sectional view showing an embodiment of the plastic zipper in accordance with the present invention which is equipped with four sealing sections.

FIG. 3 shows a plastic zipper which has four sealing sections. An independent wall 34 is provided inside of the male hooks 21 and 23, and the female hooks 11 and 13 are provided with two pressing ribs **31*a* and 31*b*, so that the wall 34 and the pressing ribs 31*a* and 31*b*** are brought in contact with each other to form the sealing section. This type of plastic zipper is wider but it is capable of providing higher hermetic sealing performance because of the double-sealing design (four sealing sections being provided). This type of plastic zipper is suited for a packaging material having a thicker film or for a large-capacity packaging material. In this embodiment, two or three or more independent walls and pressing ribs may be provided as necessary.

Figure 4:
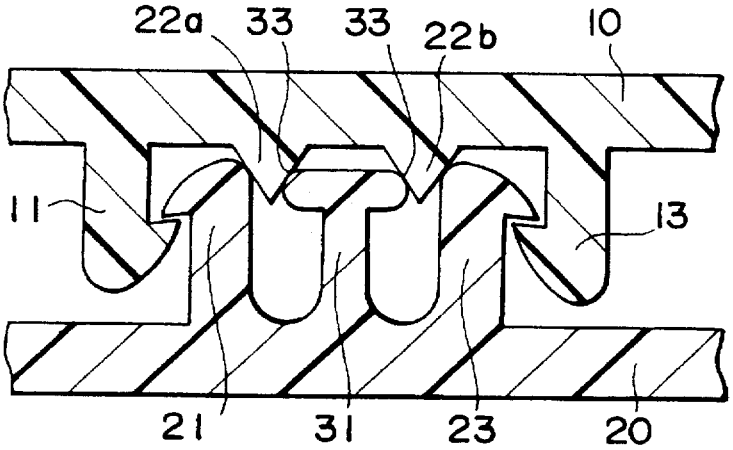
FIG. 4 is a cross-sectional view showing an embodiment of the plastic zipper in accordance with the present invention wherein the inside of the male hooks is provided with a pressing rib.

FIG. 4 illustrates a plastic zipper wherein the pressing rib 31 is provided between the male hooks 21 and 23 and tightening walls **22*a* and 22*b* are provided between the female hooks 11 and 13. In this embodiment, the pressing rib 31 has a wider distal end which comes in contact with both tightening walls 22*a* and 22*b* to form the sealing section. Further, by using an elastic material, the sealing sections are formed by the outer side walls of the tightening walls 22*a* and 22*b* and the male hooks 21 and 23**.

Figure 5:
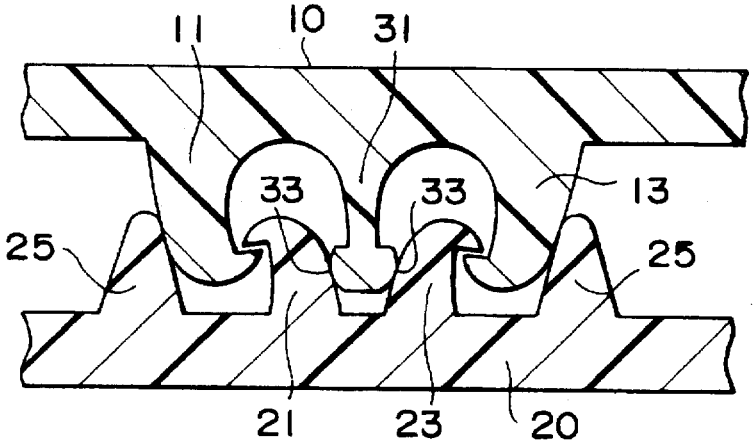
FIG. 5 is a cross-sectional view showing an embodiment of the plastic zipper in accordance with the present invention which is equipped with locking holders for preventing the locking section from unlocking.

For a plastic zipper which is required to be resistant to high pressure or to provide a larger capacity, lock holders 25 may be provided as illustrated in FIG. 5 to prevent the female and male hooks from easily disengaging due to internal pressure. In this case, if only the resistance to internal pressure is a major concern, then the lock holder 25 may be provided only inside of the packaging material.

Figure 6:
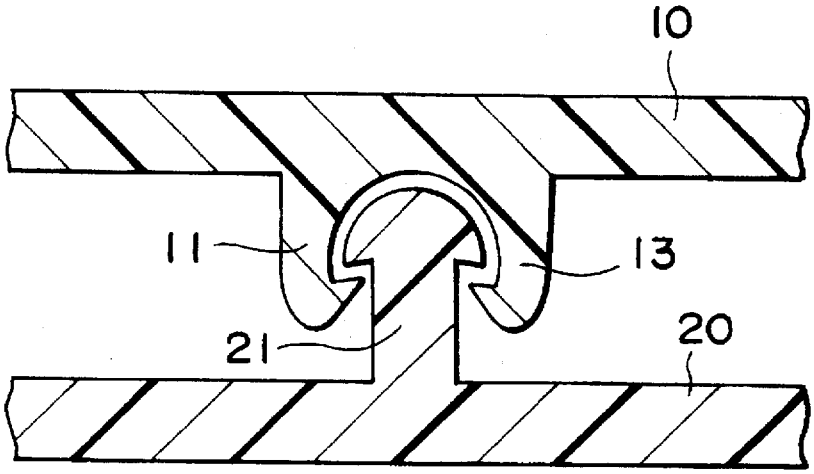
FIG. 6 is a cross-sectional view showing a conventional plastic zipper.
Figure 7:
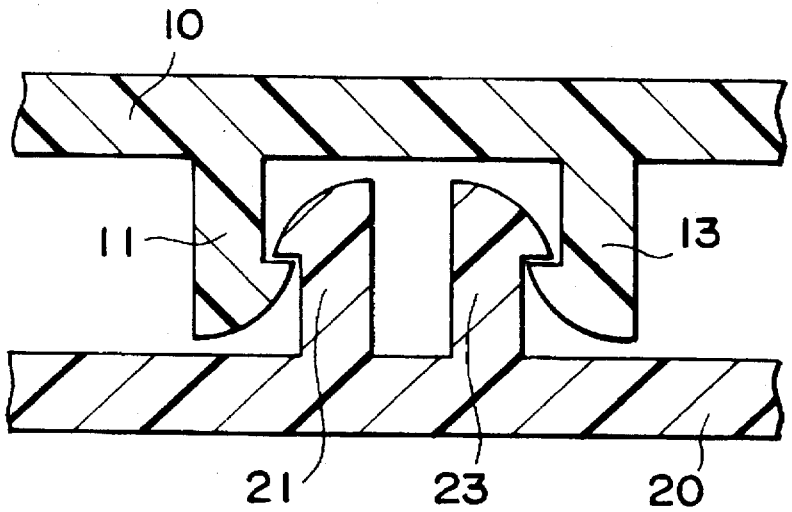
FIG. 7 is a cross-sectional view showing another conventional plastic zipper.

In comparison with the plastic zippers described above, the conventional plastic zippers provide the locking sections also as the sealing sections as shown in FIG. 6 or FIG. 7 rather than being equipped with independent sealing sections. The conventional plastic zippers therefore are hardly capable of ensuring complete hermetic sealing.

Conventionally, many plastic zippers have been proposed which are designed to form the locking section by hooks and to make the locking section serve also as the sealing section. The locking section, however, is expected to fulfill many objects; for example, it is required to lock completely, open easily, and permit easy reseal. It is extremely difficult for plastic zippers to satisfy the demand for complete sealing and all the requirements mentioned above at the same time. For this reason, there has not yet been available any plastic zippers which provide secure sealing.

According to the present invention, the locking section is not expected to provide the sealing function; it is focused only on securing the locking function. The sealing section is provided separately from the locking section; pressing ribs are urged against tightening walls (or the wall surfaces on the opposite side from the hooks in some cases) so as to form contact, preferably line contact, thereby constituting the sealing section to achieve hermetic sealing.

The locking section has a function for defining the level of adhesion pressure at the sealing section and the sealing section interlocks with the locking section when the locking section is fitted so as to enhance their functions mutually. This feature prevents the zipper from opening when it is subjected to the internal pressure of the container or to a shock from falling.

In the conventional packaging materials, when making a container with a zipper, the ends of the zipper are crushed by heat sealing. This causes the zipper to lose the sealing function thereof and a content inside the container frequently leaks through the crushed ends. The reason for such leakage will be described with reference to FIG. 6 which shows a general-purpose zipper. When the zipper is crushed by heat sealing when making the container, the male and female hooks deform and a gap is produced between the crushed part and intact part because of the deformed male and female hooks. As a result, even when the zipper is closed, the container is incompletely sealed and the content leaks through the gap. The same problem occurs also in the general-purpose zipper shown in FIG. 7; no complete sealing is possible in the vicinity of the thermally sealed part.

In the plastic zipper in accordance with the present invention, the sealing function of the zipper is provided by the sealing section which is independent of the hook section, i.e. the locking section. For example, the tightening walls which are formed separately from the hooks and the pressing ribs constitute the sealing function. Hence, since the tightening walls are tapered or V-shaped, the plastic zipper in accordance with the present invention does not lose the sealing function, which is provided by the tightening walls and the pressing ribs, even if the hooks somewhat is crushed when making the container.

Specifically, in the container producing process, the female and male hooks inevitably deform when the closed zipper is crushed by heat sealing; however, the hooks themselves do not disengage. Furthermore, the pressing ribs pressed against the tightening walls go deeper and are melted and fastened, so that leakage through the fused portion or in the vicinity thereof can be securely prevented. This also contributes to easy forming of the packaging material.

In addition, conventionally, in order to manufacture leakage-free containers, a general-purpose zipper is used although it is not perfect, and a heating bar for heat sealing is employed which is specially designed to reduce the chance of the hooks incurring deformation at the time of heat sealing. The use of the plastic zipper in accordance with the present invention eliminates the need for such special considerations; therefore, a general-purpose heat sealing machine can be used and high-speed sealing and curved sealing can be performed easily.

The plastic zipper in accordance with the present invention is competitive with the conventional plastic zippers in the aspects of light weight and cost; further, it has been significantly improved over the conventional plastic zippers in the resistance of the sealing to shock and pressure while maintaining the ease of opening and resealing. The plastic zipper in accordance with the present invention can be ideally used as the zipper for a plastic packaging material which is subjected to internal pressure or which has a large capacity.

The packaging materials including gusset containers, standing pouches, paper packs, and deep draw containers are resistant to the stress from dropping or stacking, enabling the packaging materials with plastic zippers to find new application fields.

EXAMPLES

The present invention will be described in further detail with reference to Examples.

Example

The resistance to opening of a polypropylene flat bag which has a zipper of the same structure as that shown in FIG. 1 and which is 140 mm wide, 200 mm high, and 100 μm thick was measured by the method in accordance with JIS Z-0238. The measurement result indicated 5.3 kg/5 cm width on the average, showing a relatively high resistance to opening. Ten flat bags of this type were filled with 700 cc of water, then dropped from a height of 30 cm according to the method specified by JIS Z-0238 to measure the resistance to dropping shock; they were dropped in two different directions, namely, in the horizontal direction and in a direction in which the zippers hit a floor surface. Then, the resistance to pressure was measured at 45 kgf. The measurements are shown in Table 1 below. Based on the measurements, it has been determined that the plastic zipper exhibits extremely good resistance to shock and leakage, making itself qualified for practical use for the packaging materials which are subjected to shock or internal pressure or which hold a large volume of liquid.

TABLE 1

| N | Resistance to Dropping Shock | Resistance to Pressure |
|---|---|---|
| 1 | No leakage | No leakage |
| 2 | No leakage | No leakage |
| 3 | No leakage | No leakage |
| 4 | No leakage | No leakage |
| 5 | No leakage | No leakage |
| 6 | No leakage | No leakage |
| 7 | No leakage | No leakage |
| 8 | No leakage | No leakage |
| 9 | No leakage | No leakage |
| 10 | No leakage | No leakage |

Comparative Example

The same test as that conducted on the embodiment described above was conducted on a flat bag which had the same size and an approximately the same resistance to opening, 5.4 kg/5 cm width on the average, as those of the embodiment, which had a general-purpose, commercially available zipper shown in FIG. 6, and which used the same material as the embodiment. Test results are as shown in Table 2; it has been concluded that the general-purpose zipper is not qualified for practical use as a packaging material for liquid in applications where it is likely to subjected to shocks or internal pressure.

TABLE 2

| N | Resistance to Dropping Shock | Resistance to Pressure |
|---|---|---|
| 1 | Leakage at 1 point of zipper | Dripped |
| 2 | Leakage at 1 point of zipper | Fully opened in 40 sec |
| 3 | Leakage at 2 points of zipper | Dripped |
| 4 | Oozing | Fully opened in 26 sec |
| 5 | Leakage at 1 point of zipper | Fully opened in 34 sec |
| 6 | Leakage at 2 points of zipper | Fully opened in 28 sec |
| 7 | Leakage at 3 points of zipper | Fully opened in 37 sec |
| 8 | Leakage at 1 point of zipper | Dripped |
| 9 | Leakage at 2 points of zipper | Fully opened in 35 sec |
| 10 | Leakage at 1 point of zipper | Fully opened in 32 sec |

In the above Example, the test was conducted on the embodiment shown in FIG. 1; it is obvious, however, that the same advantages will be obtained also in the embodiments shown in FIG. 2 through FIG. 5.

While the invention has been described in detail and with reference to speciiic embodiments thereof, it will be apparent to one of ordinary skill in the art that various changes and modifications can be made therein without departing from the spirit and scope thereof.

What is claimed is:

1. A plastic zipper, comprising: a pair of female hooks (11, 13) and a pair of male hooks (21, 23) formed on the surface of respective plastic films (10, 20), wherein an inside of the female hooks and an inside of the male hooks are engaged with each other to form a sealing section independent of a locking section which comprises a pair of female and male hooks of said zipper, wherein the sealing section is formed between a groove-like tightening wall provided inside of the hooks on one side of the locking section and a pressing rib provided inside of the hooks on another, opposite side thereof, wherein a section of the tightening wall inside of the hooks is shaped like a continuous groove which is narrower downward and wider upward, and wherein the pressing rib and a surface of the tightening wall come in line contact to form the sealing section.

2. The plastic zipper according to claim 1, wherein at least one independent wall is provided inside of the hooks on said one side and at least two pressing ribs are provided inside of the hooks on said opposite side, so that the independent wall is brought in contact with the inside of the pressing ribs so as to form the sealing section.

3. The plastic zipper according to claim 1, wherein at least two tightening walls are provided inside of the hooks on the one side and at least one pressing rib is provided inside of the hooks on the other side, the pressing rib having a distal end extended on both sides which comes in contact with both tightening walls to form the sealing section, and the outside walls of the tightening walls and the hooks on the other side forming the sealing section.

4. A plastic zipper, comprising: a pair of female hooks (11, 13) and a pair of male hooks (21, 23) formed on the surface of respective plastic films (10, 20), wherein an inside of the female hooks and an inside of the male hooks are engaged with each other to form a sealing section independent of a locking section which comprises a pair of female and male hooks of said zipper, wherein the sealing section is formed between a groove-like tightening wall provided inside of the hooks on one side of the locking section and a pressing rib provided inside of the hooks on another, opposite side thereof, and wherein at least one independent wall is provided inside of the hooks on said one side and at least two pressing ribs are provided inside of the hooks on said opposite side, so that the independent wall is brought in contact with the inside of the pressing ribs so as to form the sealing section.

5. A plastic zipper, comprising: a pair of female hooks (11, 13) and a pair of male hooks (21, 23) formed on the surface of respective plastic films (10, 20), wherein an inside of the female hooks and an inside of the male hooks are engaged with each other to form a sealing section independent of a locking section which comprises a pair of female and male hooks of said zipper, wherein the sealing section is formed between a groove-like tightening wall provided inside of the hooks on one side of the locking section and a pressing rib provided inside of the hooks on another side thereof, wherein at least two tightening walls are provided inside of the hooks on said one side and at least one pressing rib is provided inside of the hooks on said opposite side, the pressing rib having a distal end extended on both sides which comes in contact with both tightening walls to form the sealing section, and outside walls of the tightening walls and the hooks on said opposite side forming the locking section.

6. The plastic zipper according to claims 1, 4 or 5, wherein a bottom portion of the tightening wall defines an elasticity enhancing recess (35).

7. The plastic zipper according to claim 4 or 5, wherein a section of the tightening wall inside of the hooks is shaped like a continuous groove which is narrower downward and wider upward.

8. The plastic zipper according to claims 4 or 5, wherein the pressing rib and a surface of the tightening wall come in line contact to form the sealing section.

9. The plastic zipper according to claims 1, 4 or 5, wherein a locking holder extends from the male hooks to the outside wall of the female hooks to contact with each other thereby forming an additional sealing section.

10. The plastic zipper according to claims 1, 4 or 5, wherein either the tightening wall or the pressing rib is made rigid and the other is made elastic.

* * * * *